US006526253B2

(12) United States Patent
Hayashi et al.

(10) Patent No.: US 6,526,253 B2
(45) Date of Patent: Feb. 25, 2003

(54) IMAGE FORMING APPARATUS

(75) Inventors: Shigeki Hayashi, Nara (JP); Toyoaki Nanba, Higashiosaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/975,224

(22) Filed: Oct. 11, 2001

(65) Prior Publication Data

US 2002/0044809 A1 Apr. 18, 2002

(30) Foreign Application Priority Data

Oct. 13, 2000 (JP) ..... P2000-314202

(51) Int. Cl.[7] ..... G03G 15/00

(52) U.S. Cl. ..... 399/391; 399/23; 271/9.01; 271/9.03

(58) Field of Search ..... 271/9.01, 9.03; 399/23, 391, 392, 393

(56) References Cited

U.S. PATENT DOCUMENTS 5,991,556 A * 11/1999 Yamashita ..... 399/23
6,285,844 B1 * 9/2001 Kuga ..... 399/85

FOREIGN PATENT DOCUMENTS

JP A 7-219401 8/1995

* cited by examiner

*Primary Examiner*—Hoang Ngo
(74) *Attorney, Agent, or Firm*—Renner, Otto, Boisselle & Sklar, LLP

(57) ABSTRACT

An image forming apparatus capable of paper feed control that can selectively feed paper in such a manner as to be able to reduce the first copy time as much as possible when there is more than one paper tray that holds the same size paper. The apparatus includes an image forming section, two or more paper accommodating sections, a paper feed means provided for each of the paper accommodating sections, and a paper feed control section for performing paper feed control so as to reduce the first copy time. The paper accommodating sections include a first paper accommodating section whose paper transport time to the image forming section is shorter and a second paper accommodating section whose paper transport time to the image forming section is longer. Paper feed control is performed so that the paper consumption in the first paper accommodating section whose paper transport time to the image forming section is shorter is reduced, thereby increasing the opportunity of being able to shorten the first copy time.

4 Claims, 11 Drawing Sheets

IMAGE FORMING APPARATUS

BACKGROUND OF THE INVENTION

1. Field of the Invention

The present invention relates to an image forming apparatus such as a copier or a printer, and more particularly to a paper feed control technique for selectively feeding paper to an image forming section.

2. Description of the Related Art

In an image forming apparatus such as a copier or a printer, the number of times a paper tray needs to be replenished with paper can be reduced and the available time of the apparatus improved by equipping the apparatus with a large capacity paper tray or a number of paper trays. For example, Japanese Unexamined Patent Publication JP-A 7-219401 (1995) discloses a technique for shortening the first copy time by mounting two paper trays in the same supporting member, both accommodating the same size paper, and by feeding at least the first sheet of paper out of the paper tray mounted nearer to the image forming section and subsequent sheets out of the paper tray mounted farther from the image forming section.

In the technique disclosed in JP-A 7-219401, in order to shorten the first copy time, a number of sheets of paper, including the first sheet, are always fed out of the paper accommodating section whose paper transport distance to the image forming section is the shortest. However, after accommodating the same size paper into a plurality of paper accommodating sections mounted in the same supporting member and constructed so as to be drawn out as a single unit, or into a plurality of paper accommodating sections mounted in separate supporting members and constructed so as to be drawn out separately, if a number of sheets of paper, including the first sheet, have to be fed out of the paper accommodating section whose paper transport distance to the image forming section is the shortest, as described above, a situation can occur where even when any one of the other paper accommodating sections mounted farther from the image forming section is ready to feed paper, the operation has to wait until the paper accommodating section whose paper transport distance to the image forming section is the shortest gets ready to feed paper, and this leads to the problem that the first copy time becomes correspondingly longer.

This problem becomes particularly apparent in the case of an image forming apparatus equipped with a large capacity paper accommodating section. For example, consider the case where the large capacity paper accommodating section ran out of paper and the user replenished the paper accommodating section with paper, but not up to the maximum capacity of it, because he was in a hurry. In this case, if the paper accommodating section replenished with paper happens to be the one whose paper transport distance to the image forming section is the shortest, the time required for the paper accommodating section to move up and get ready for paper feed after the paper replenishment may be longer than the difference between the time that would be required to transport paper from that paper accommodating section to the image forming section and the time that would be required to transport paper to the image forming section from some other paper accommodating section having a longer paper transport distance to the image forming section.

In that case, with the technique described in JP-A 7-219401, since a number of sheets of paper, including the first sheet, are always fed out of the paper accommodating section whose paper transport distance to the image forming section is the shortest, there remains the problem that the first copy time becomes longer by the time required for that (large capacity) paper accommodating section to get ready for paper feed, as described above.

SUMMARY OF THE INVENTION

An object of the invention is to provide an image forming apparatus capable of paper feed control that can reduce the first copy time as much as possible when there is more than one paper tray that holds the same size paper.

The invention provides an image forming apparatus comprising:

an image forming section for forming an image on paper;

a first paper accommodating section for accommodating therein prescribed size paper specified to be fed to the image forming section, the first paper accommodating section being movable between a paper replenishment position where paper can be replenished, and a paper feed position where the paper is ready to be fed out;

a second paper accommodating section for accommodating therein paper of the same size as the paper held in the first paper accommodating section, the second paper accommodating section being movable between a paper replenishment position where paper can be replenished, and a paper feed position where the paper is ready to be fed out, and requiring a longer time than that of the first paper accommodating section to transport the paper to the image forming section;

paper feed means, provided for each of the paper accommodating sections, for feeding the paper placed in the paper accommodating sections to the image forming section one sheet of paper at a time; and a paper feed control section for performing control in such a manner that when setting each of the first and second paper accommodating sections from the paper replenishment position to the paper feed position, in the case where one of the paper accommodating sections has been set into the paper feed position earlier than the other paper accommodating section, paper feed is started from the paper accommodating section that has been set into the paper feed position earlier.

In the invention, the paper feed control section performs control in such a manner that when setting each of the first and second paper accommodating sections from the paper replenishment position to the paper feed position, in the case where the first paper accommodating section has been set into the paper feed position earlier than the second paper accommodating section, paper feed is first started from the first paper accommodating section, and after the second paper accommodating section has been set into the paper feed position and become ready to feed paper following the paper being fed out of the first paper accommodating section, paper feed from the first paper accommodating section is stopped and paper feed from the second paper accommodating section is started.

In the invention, the paper feed control section performs control in such a manner that when setting each of the first and second paper accommodating sections from the paper replenishment position to the paper feed position, in the case where the second paper accommodating section has been set into the paper feed position earlier than the first paper accommodating section, paper feed is first started from the second paper accommodating section, and after the first paper accommodating section has been set into the paper feed position and become ready to feed paper following the paper being fed out of the second paper accommodating section, paper feed from the second paper accommodating section is stopped and paper feed from the first paper accommodating section is started.

According to the invention, the first copy time is prevented from becoming longer due to the time difference occurring when setting each of the first and second paper accommodating sections from the paper replenishment position to the paper feed position, and also, the paper consumption in the paper accommodating section whose paper transport time to the image forming section is shorter is reduced, thereby increasing the opportunity of being able to shorten the first copy time, while at the same time, substantially equalizing the cumulative number of sheets handled by the paper feed means between the two paper accommodating sections so that both paper feed means can be replaced at a time.

The invention also provides an image forming apparatus comprising:

an image forming section for forming an image on paper;

a first paper accommodating section for accommodating therein prescribed size paper specified to be fed to the image forming section, the first paper accommodating section being movable between a paper replenishment position where paper can be replenished, and a paper feed position where the paper is ready to be fed out;

a second paper accommodating section for accommodating therein paper of the same size as the paper held in the first paper accommodating section, the second paper accommodating section being movable between a paper replenishment position where paper can be replenished, and a paper feed position where the paper is ready to be fed out, and requiring a longer time than that of the first paper accommodating section to transport the paper to the image forming section;

paper feed means, provided for each of the paper accommodating sections, for feeding the paper placed in the paper accommodating section to the image forming section one sheet of paper at a time; and a paper feed control section for performing control in such a manner that when feeding paper from the second paper accommodating section to the image forming section, in the case where the second paper accommodating section runs out of paper, an indication is produced signaling the need to replenish the second paper accommodating section with paper, while at the same time, paper is fed out of the first paper accommodating section, following the paper fed out of the second paper accommodating section, and thereafter, when the second paper accommodating section has been replenished with paper, and when the second paper accommodating section has been set into the paper feed position and become ready to feed paper following the paper being fed out of the first paper accommodating section, paper feed from the first paper accommodating section is stopped and paper feed from the second paper accommodating section is resumed.

According to the invention, when the second paper accommodating section needs to be replenished with paper, paper is fed out of the first paper accommodating section instead of the second paper accommodating section, and after the second paper accommodating section has been replenished with paper and become ready to feed paper following the paper being fed out of the first paper accommodating section, paper feed from the second paper accommodating section is resumed; as a result, not only can the paper consumption in the first paper accommodating section be reduced, but the image forming operation can be continued while the second paper accommodating section is being replenished with paper, and the print job can be completed without delay.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
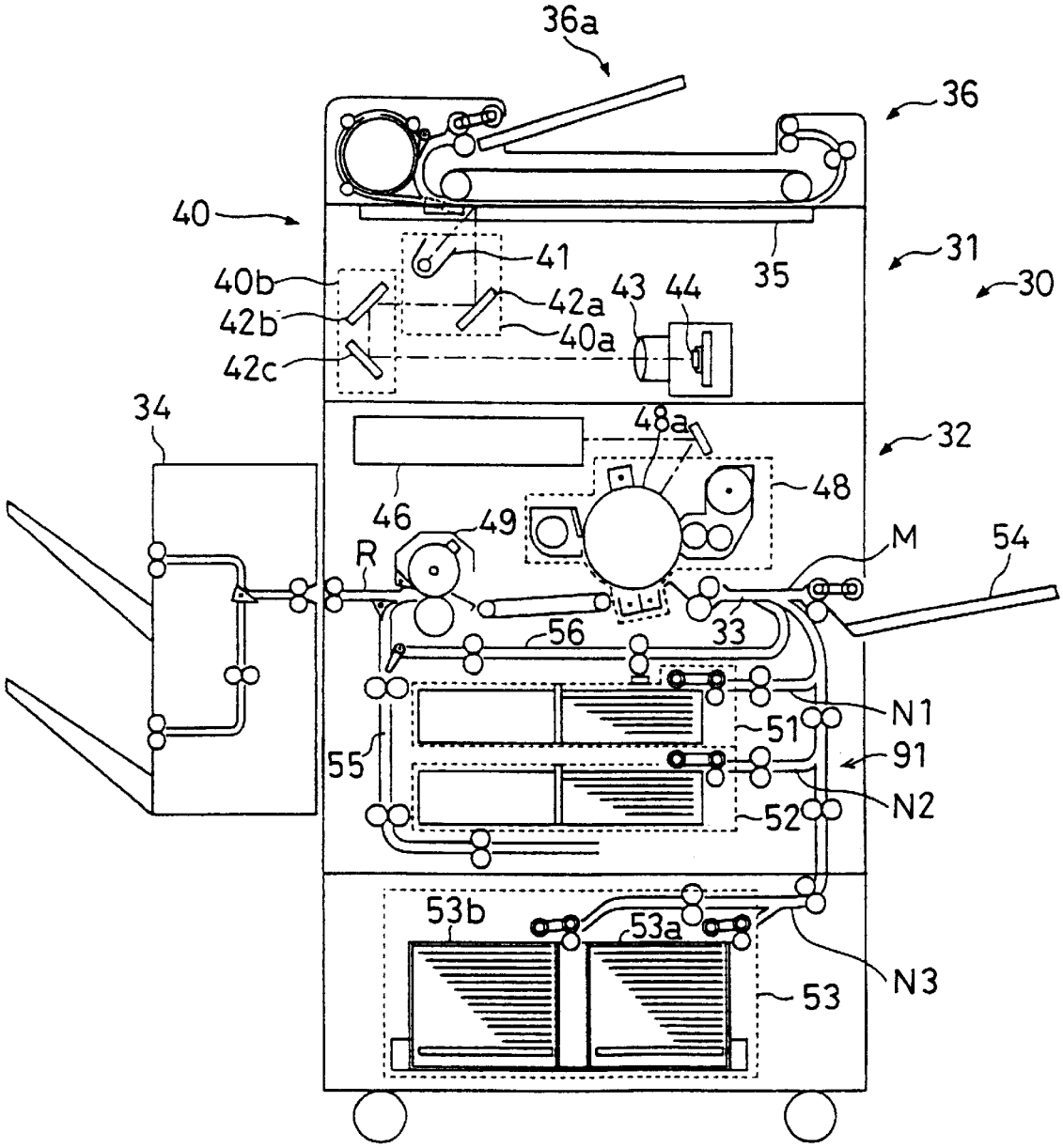
FIG. 1 is a diagram showing the construction of a digital copying machine as an image forming apparatus according to one embodiment of the invention.

Now referring to the drawings, preferred embodiments of the invention are described below.

FIG. 1 shows the construction of a digital copying machine 30; the main body of the digital copying machine 30 consists primarily of two sections, a scanner section 31 as a document reading device and a laser recording section 32. The scanner section 31 comprises a contact glass 35 as a document table made of transparent glass, a reversing automatic document feeder (RADF) 36 for automatically feeding documents onto the contact glass 35, and a scanner unit 40, that is, a document image reading unit, disposed directly below the contact glass 35, for reading document images by scanning.

In the scanner section 31, a CCD (Charge Coupled Device) image sensor 44, described later, captures image data by reading the image of the document placed on the contact glass 35, and the captured document image is output from the CCD image sensor 44 to apply prescribed image processing to the image data.

The RADF 36 is a device that automatically feeds a plurality of documents stacked in a document tray 36*a* one by one onto the contact glass 35 of the scanner unit 40. In order to allow only one side or both sides of a document to be read by the scanner unit 40 in accordance with an operator's selection, the device comprises a transport path for a one-sided document, a transport path for a two-sided document, a transport path switching means, sensors for monitoring and managing the condition of the document passing through the various portions, and a controller. It will, however, be appreciated that the RADF 36 is not an essential device to the invention.

On the other hand, the scanner unit 40 forming part of the scanner section 31 comprises a lamp reflector assembly 41 as a scanning means for scanning a document by projecting light onto the document surface, the CCD image sensor 44 for converting the light image reflected from the document into an electrical image signal, a first scanning unit 40*a* mounted with a first reflecting mirror 42*a* for reflecting light reflected from the document in order to direct the reflected light image of the document toward the CCD image sensor 44, a second scanning unit 40*b* mounted with a second reflecting mirror 42*b* and third reflecting mirror 42*c* for directing the reflected image reflected from the first reflecting mirror 42*a* toward the CCD image sensor 44, and an optical lens 43 for focusing onto the CCD image sensor 44 the reflected image of the document reflected via the reflecting mirrors 42*a*, 42*b*, and 42*c*.

In the scanner section 31, the RADF 36 sequentially places the documents to be read onto the contact glass 35 and the scanner unit 40, in coordination with the operation of the RADF 36, reads the document images by scanning along the underside of the contact glass 35. In the scanner unit 40, the first scanning unit 40*a* is moved at a constant speed V (not shown) along the contact glass 35 from left to right in the figure, that is, in the sub-scanning direction A.

On the other hand, the second scanning unit 40*b* is controlled to scan along the same direction A at a speed V/2 (not shown) one half the speed V of the first scanning unit 40*a*. By controlling the scanner unit 40 in this way, each document placed on the contact glass 35 can be read by sequentially focusing the document image line by line onto the CCD image sensor 44.

The image data obtained by reading the document image by the scanner unit 40 is sent to an image processing means not shown and, after being subjected to various kinds of processing, is temporarily stored in a memory in the image processing means. Then, in response to an output command, the image stored in the memory is read out and transferred to the laser recording section 32 to form the image on recording paper. The laser recording section 32 comprises a transport system for transporting recording paper for image formation, a laser writing unit 46, and an electrophotographic process unit 48 as an image forming unit for forming images.

The laser writing unit 46 contains a semiconductor laser light source, polygon mirror, fθ lens, etc. not shown. The semiconductor laser light source emits laser light modulated in accordance with the image data captured by the scanner unit 40 and stored in the memory or image data transferred from an external device.

The laser light is deflected at a constant angular speed by the polygon mirror, and is corrected by the fθ lens in such a manner as to move at a constant speed on a photoconductor drum 48*a* which forms part of the electrophotographic process unit 48. The electrophotographic process unit 48 employs a known construction and comprises a charge unit, developing unit, transfer unit, separation unit, cleaning unit, erase unit, etc. disposed around the photoconductor drum 48*a*.

On the other hand, the recording paper transport system comprises: a transport section for transporting recording paper to the transfer position where the transfer unit of the electrophotographic process unit 48 for image formation is located; various paper trays 51, 52, and 53 for feeding recording paper to the transport section and a manual feed unit 54 for manually feeding recording paper of desired size as required; a fixing unit 49 for fixing the toner image, i.e., the image transferred and formed on the recording paper; and a two-sided copy transport path 55 for feeding the recording paper again for image formation on the reverse side thereof after the image has been fixed to the first side of the recording paper.

On the downstream side of the fixing unit 49 is mounted a finishing unit 34 which receives recording paper with images formed thereon and applies prescribed processing (for example, sorting of sheets according to print mode, stapling, punching, etc.) to the recording paper. The paper trays 51, 52, and 53 are essential component elements of the invention, and will be described in detail later.

In the thus constructed laser recording section 32, the image data read out of the image memory is formed as an electrostatic latent image on the surface of the photoconductor drum 48*a* of the electrophotographic process unit 48 by the laser beam emitted from the laser write unit 46, and the image made visible as a toner image by toner is electrostatically transferred onto the surface of the paper transported from one of the paper trays 51, 52, and 53 in the multi-stack paper feed unit or from the manual feed unit 54, and fixed to the paper by the fixing unit 49. The paper with the image formed thereon is transported from the fixing unit 49 into the finishing unit 34.

The paper transport paths through which paper is transported in the above apparatus consist primarily of a main transport path 33, first paper tray paper transport path N1, second paper tray paper transport path N2, large capacity paper tray paper transport path N3, two-sided copy transport path 55, manual feed transport path M, and exit transport path R. Of these transport paths, the large capacity tray paper transport path N3 will be described in detail later.

Figure 2:
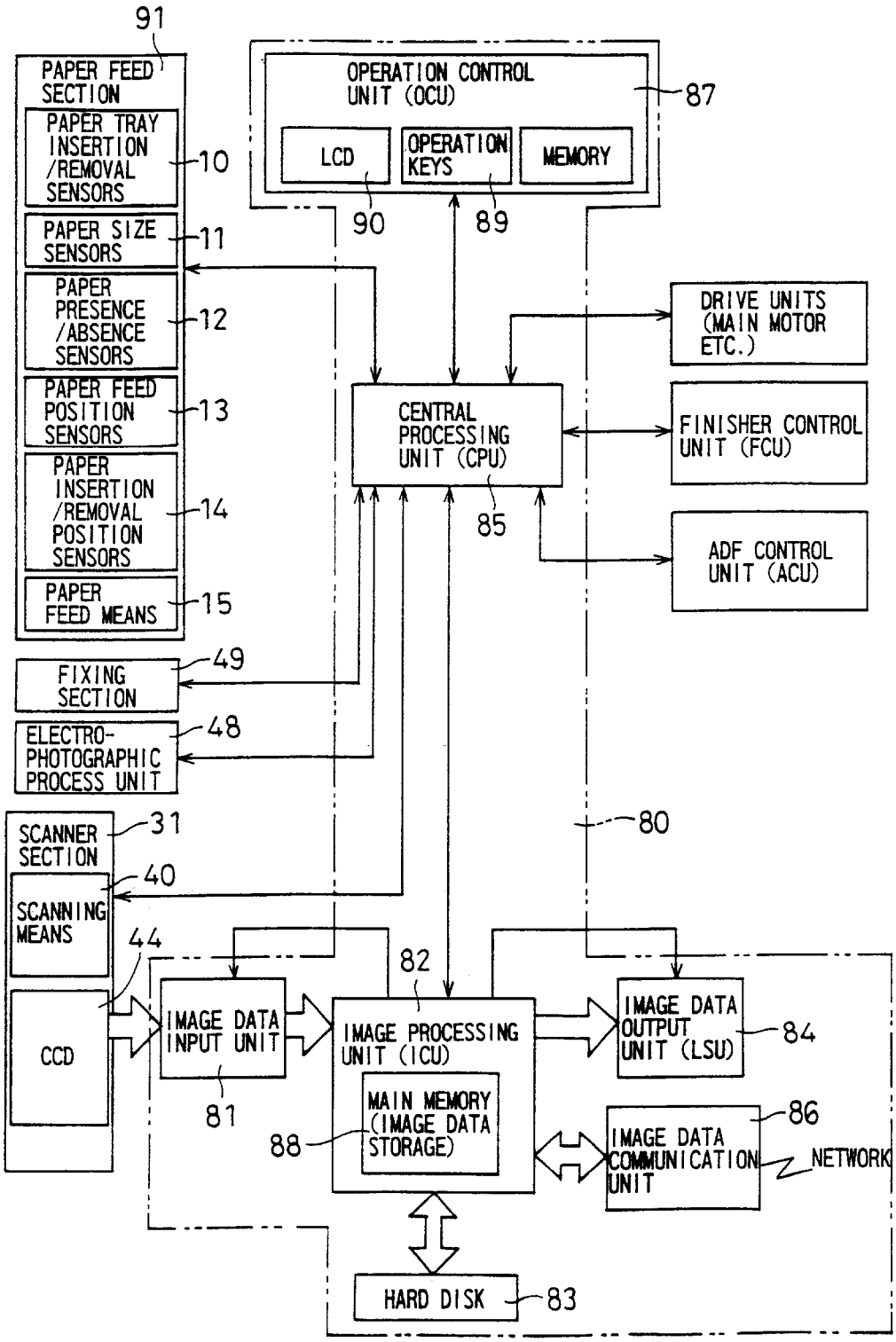
FIG. 2 is a control system block diagram for an image processing section, etc.

Next, the configuration and functions of the image processing means 80 mounted in the digital copying machine 30 of FIG. 1 will be described below with reference to FIG. 2 which illustrates how the various parts of the digital copying machine 30 are controlled by a central processing unit (CPU).

The image processing means 80 incorporated in the digital copying machine 30 consists primarily of an image data input unit 81, image processing unit 82, hard disk 83, image data output unit 84, central processing unit 85, image data communication unit 86, and operation control unit 87.

The image data input unit 81 applies processing such as shading corrections to the line data read by the CCD image sensor 44. The image processing unit 82 processes the image signal supplied from the image data input unit 81 by applying corrections such as area separations and base color elimination and also applying zooming, i.e., magnification or demagnification, to the input image information in accordance with preset magnification ratio, and the processed image is stored on the hard disk 83 as well as in the main memory 88 of the image processing unit 82.

The image data output unit 84 write the image data, read out of the main memory 88, to the electrophotographic process unit 48 by controlling the laser write unit 46. The image data communication unit 86 is a communication interface means for receiving image data from an external image input processing device (portable communication terminal, digital camera, digital video camera, etc.) connected externally to the digital copying machine 30.

The image data input via the image data communication unit 86 is also supplied to the image processing unit where the data is processed for color space corrections, etc. and converted to the data level that can be handled by the electrophotographic process unit 48 of the digital copying machine 30, and the processed image data is stored on the hard disk 83, etc. for management.

The central processing unit 85 manages by sequence control the image data input unit 81, image processing unit 82, image data output unit 84, and image data communication unit 86 as well as the ADF control unit, scanner section 31, and other drive mechanisms of the digital copying machine 30, and outputs control signals to the various units. Further, the operation control unit 87 comprising operation keys 89, etc. is connected to the central processing unit 85 in such a manner as to be able to communicate with each other, and a control signal representing the copy mode preset by the user by operating the operation keys 89 is transferred to the central processing unit 85 to control the entire operation of the digital copying machine 30 in accordance with the preset mode.

The central processing unit 85, on the other hand, transfers control signals indicating various operating states of the digital copying machines 30 to the operation control unit 87, and the operation control unit 87, in accordance with the received control signal, displays the operating state on a liquid crystal display (LCD) 90 or the like to indicate the current operating state of the apparatus to the user.

Figure 5:
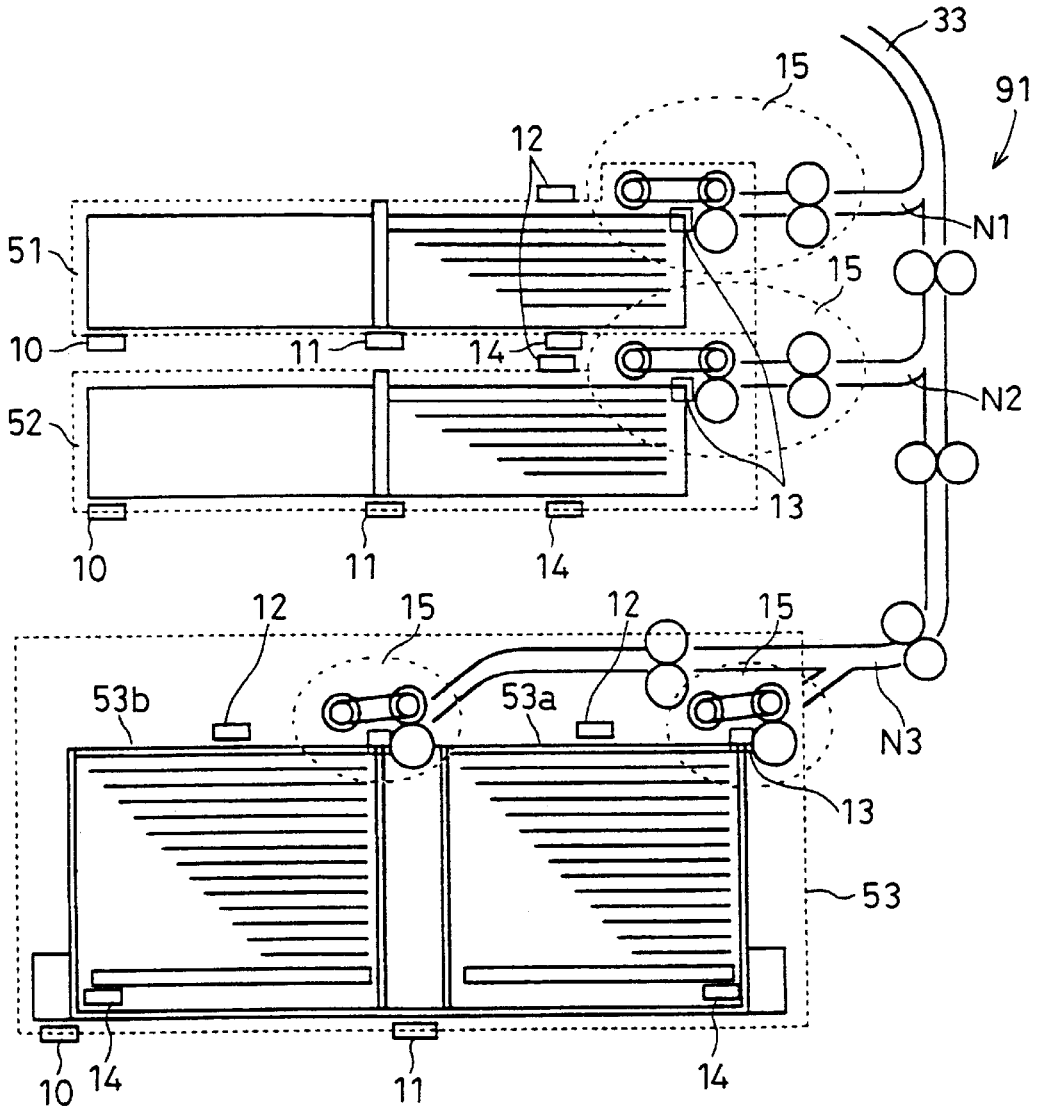
FIG. 5 is an explanatory diagram showing the arrangement of paper trays and sensors.

FIG. 5 shows the detailed construction of the paper trays 51, 52, and 53 in FIG. 1; as shown, a paper feed section 91, which constitutes an essential part of the invention, comprises paper tray insertion/removal sensors 10 for detecting the insertion and removal of the respective paper trays, paper size sensors 11 for detecting the size of the paper placed in the respective trays, paper presence/absence sensors 12 for detecting the presence or absence of paper in the respective trays, paper feed position sensors 13 for detecting whether paper in the respective trays has reached the paper feed position, a paper insertion/removal position sensor 14 for detecting whether the tray is set in the paper replenishment position, and paper feed means 15 for feeding paper from the respective trays into the main transport path 33. Herein the paper replenishment position indicates positions of the respective trays where paper is replenished thereon. For example, the paper replenishment position of the tray 53 indicates a position where first and second plates 61, 62, which are referred to later, are placed so as to be close to the paper feed unit frame 63, with the tray 53 disconnect from the main body of the copying machine 30.

Next, a description will be given of the construction and other features designed to reduce the first copy time (print standby time) in the digital copying machine 30.

Figure 3:
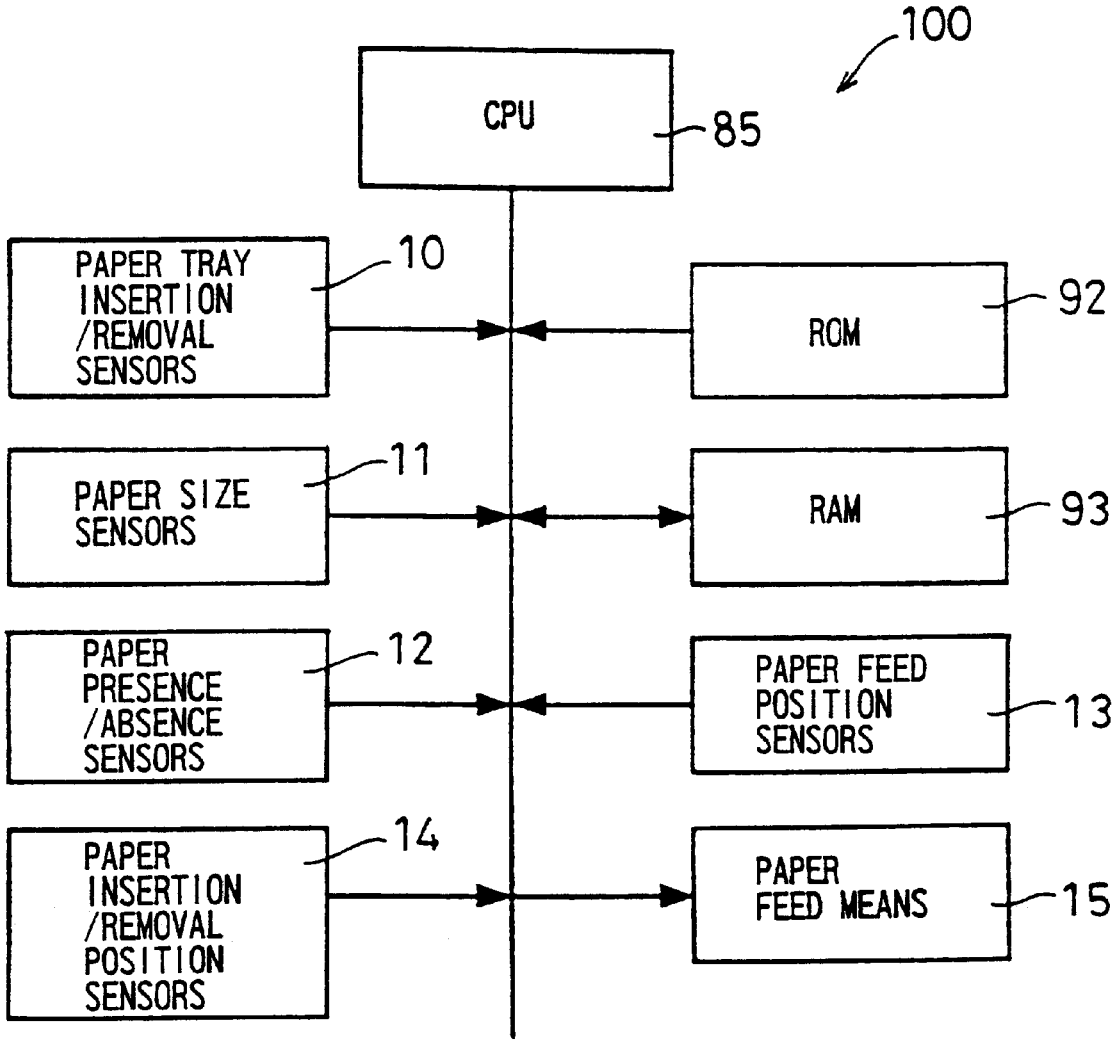
FIG. 3 is a control system block diagram for a paper feed control unit.

First, the paper feed control unit 100 for performing control to reduce the first copy time comprises, as shown in FIG. 3, a CPU (central processing unit) 85 and a read only memory (ROM) 92 and random access memory (RAM) 93 which provide memory capability, and on the input side thereof are connected the various sensors 10 to 14 in the paper feed section 91, while the paper feed means 15 are connected on the output side. Paper feed control as described below is performed in accordance with paper feed control programs stored in the ROM 92.

The paper feed control will be described below with reference to FIG. 1 and FIGS. 4 to 13.

In the recording paper transport system in FIG. 1, the paper trays 51, 52, and 53 for feeding recording paper into the transport section are paper cassettes which are loaded with recording paper of various sizes and qualities (plain paper, OHP sheets, high quality paper, etc.) that the user can select as required. Among them, the large capacity paper tray 53 is a paper cassette that usually holds recording paper used frequently or used when printing in large quantities. The large capacity paper tray 53 has a plurality of paper accommodating sections, i.e., a large capacity paper tray first paper feed section 53*a* as a first paper accommodating section and a large capacity paper tray second paper feed section 53*b* as a second paper accommodating section. When the user makes a print request specifying the use of the large capacity paper tray 53, the apparatus itself decides which paper feed section should be used.

Figure 4:
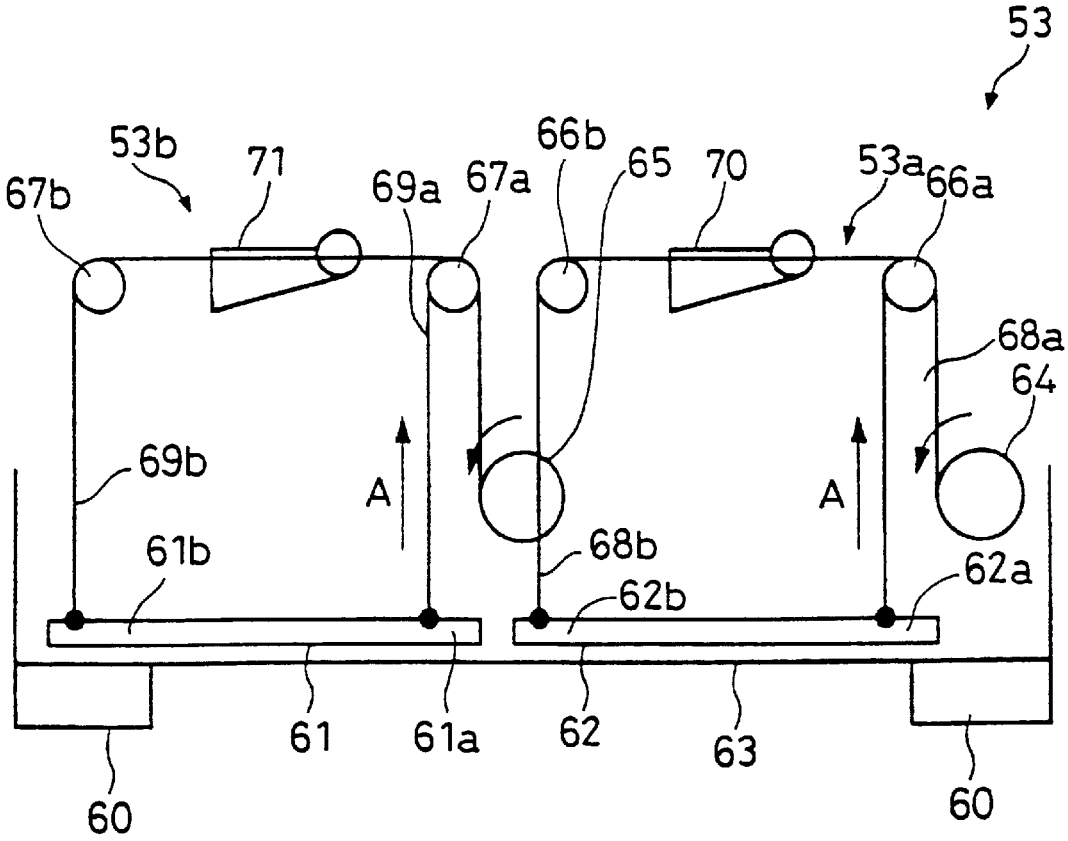
FIG. 4 is an explanatory diagram showing lift mechanisms for a large capacity paper tray.

FIG. 4 shows paper-feed lift mechanisms used in the large capacity paper tray 53 in FIG. 1. As been shown in FIG. 1, the large capacity paper tray 53 includes the large capacity paper tray first paper feed section 53*a* and the large capacity paper tray second paper feed section 53*b*, which are equipped with respectively independent paper-feed lift mechanisms both mounted in a paper feed unit frame 63 integrally formed with drawer rails 60.

The paper-feed lift mechanism for the large capacity paper tray first paper feed section 53*a* includes a first plate 62 on which recording paper is placed, a first lift motor 64, a pair of pulleys 66*a* and 66*b*, a pair of first wires 68*a* and 68*b*, and a first upper limit switch 70. The first lift motor 64 controls the lifting of the first plate 62. The pair of pulleys 66*a* and 66*b* are positioned one spaced apart from the other in the upper part of the first paper feed section 53*a*. The first wire 68*a* is run over the pulley 66*a*. One end of the first wire 68*a* is fixed to one end 62*a* of the first plate 62. The other end of the first wire 68*a* is fixed to the first lift motor 64. The other first wire 68*b* is run over the pair of pulleys 66*a* and 66*b*. One end of that other first wire 68*b* is fixed to the other end 62*b* of the first plate 62. The other end of the first wire 68*b* is fixed to the first lift motor 64. In this construction, the first plate 62 suspended from the pair of first wires 68*a* and 68*b* is moved up and down by being driven by the first lift motor 64. The first upper limit switch 70 detects contacting or noncontacting state of recording paper.

When a noncontacting state of recording paper is detected by the first upper limit switch 70, the first lift motor 64 is driven to wind the first wires 68*a* and 68*b* via the pulleys 66*a* and 66*b*, causing the first plate 62 to move up. When the contacting state of recording paper is detected by the first upper limit switch 70, the first lift motor 64 is stopped. The basic construction of the mechanism for the large capacity paper tray second paper feed section 53*b* is the same as that for the large capacity paper tray first paper feed section 53*a*. That is, the paper-feed lift mechanism for the large capacity paper tray second paper feed section 53*b* includes a second plate 61 on which recording paper is placed, a second lift motor 65, a pair of pulleys 67*a* and 67*b*, a pair of second wires 69*a* and 69*b*, and a second upper limit switch 71. The second lift motor 65 controls the lifting of the second plate 61. The pair of pulleys 67*a* and 67*b* are positioned one spaced apart from the other in the upper part of the second paper feed section 53*b*. The second wire 69*a* is run over the pulley 67*a*. One end of the second wire 69*a* is fixed to one end 61*a* of the second plate 61. The other end of the second wire 69*a* is fixed to the second lift motor 65. The other second wire 69*b* is run over the pair of pulleys 67*a* and 67*b*. One end of that other second wire 69*b* is fixed to the other end 61*b* of the second plate 61. The other end of the second wire 69*b* is fixed to the second lift motor 65. In this construction, the second plate 61 suspended from the pair of second wires 69*a* and 69*b* is moved up and down by being driven by the second lift motor 65. The second upper limit switch 71 detects contacting or noncontacting state of recording paper.

Next, how the sensors and paper trays shown in FIG. 5 interact with each other during paper feed and paper replenishment operations will be described below with reference to the flow charts shown in FIGS. 6, 7A, 9A, 10, 12A, and 13A and the data structure diagrams shown in FIGS. 7B, 8, 9B, 9C, 11, 12B, and 13B.

Figure 6:
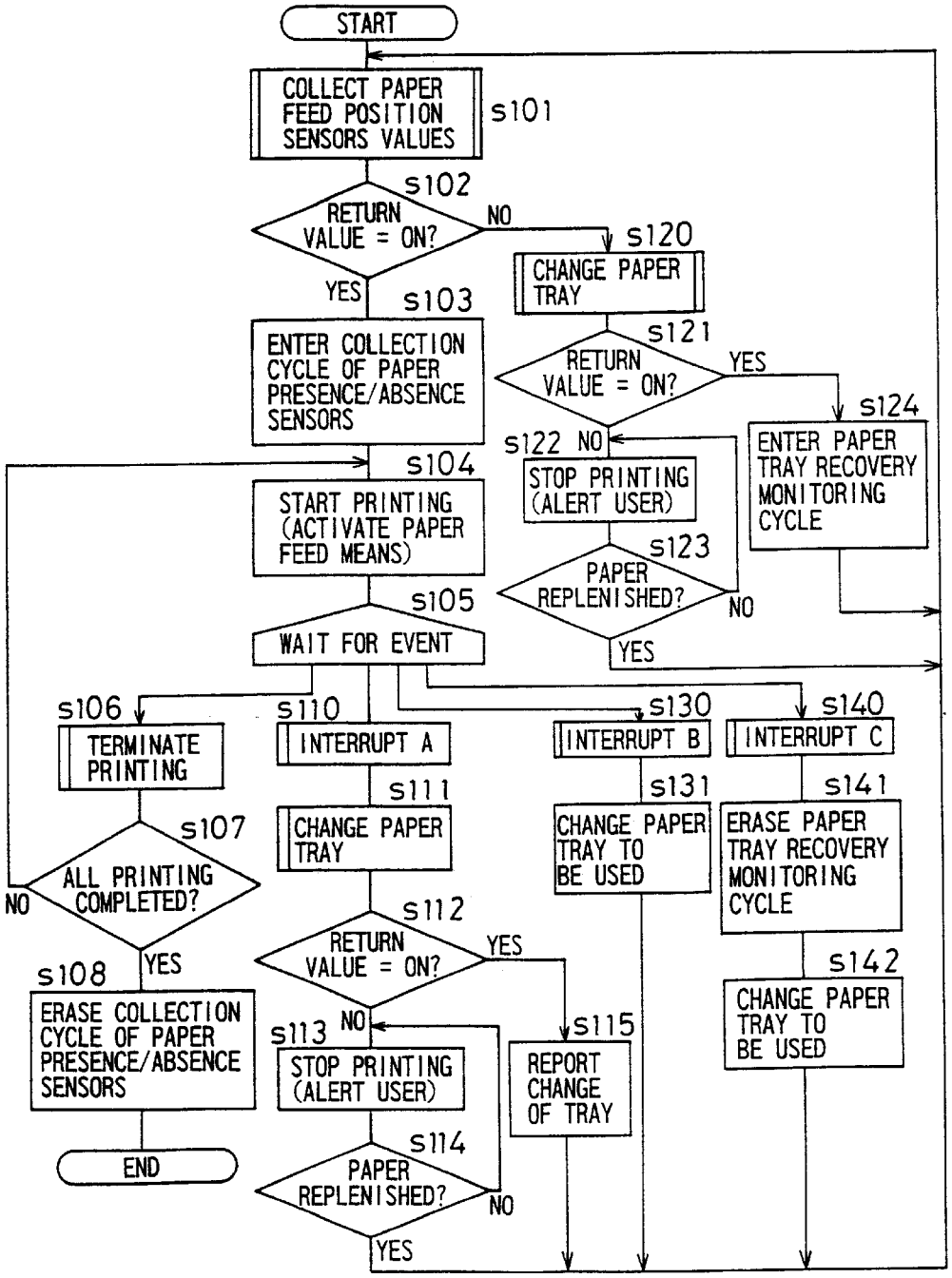
FIG. 6 is a flow chart showing a main routine for paper tray switching procedures.
Figure 7A:
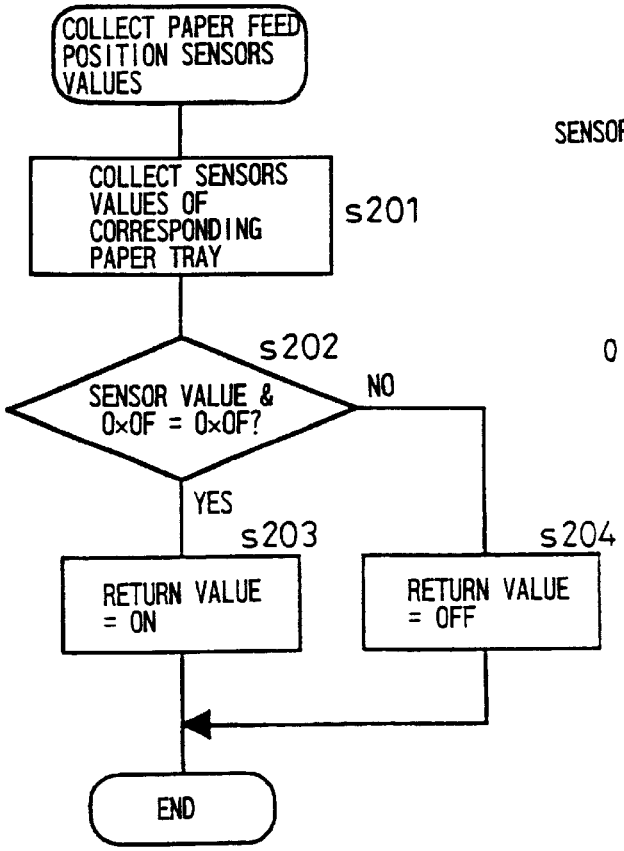
FIG. 7A is a flow chart showing a paper feed position sensor collection routine.
Figure 7B:
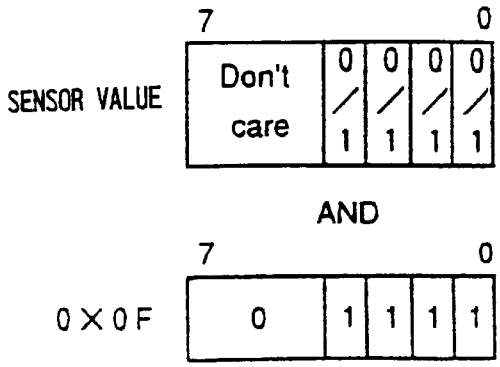
FIG. 7B is a data structure diagram showing the ANDing of sensor value and prescribed value 0x0F.
Figure 8:
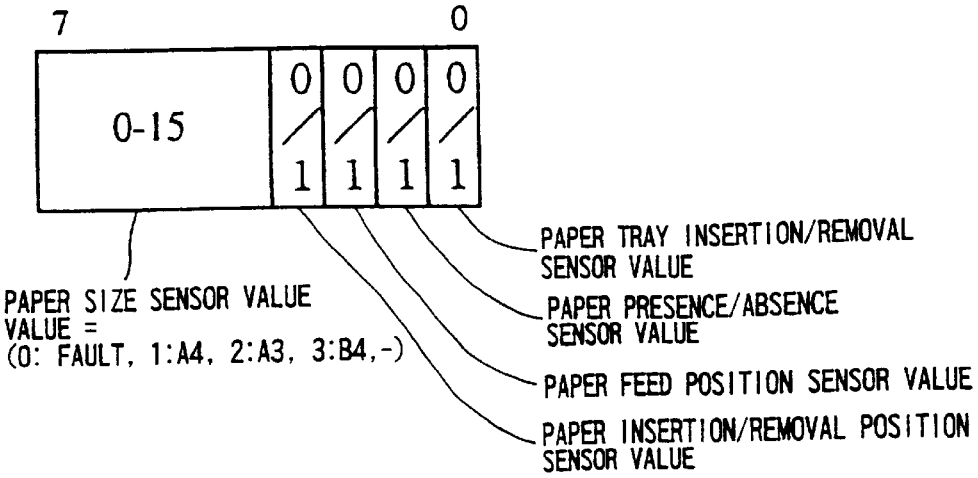
FIG. 8 is a diagram showing the data format obtained when collecting the states of various sensors.
Figure 9A:
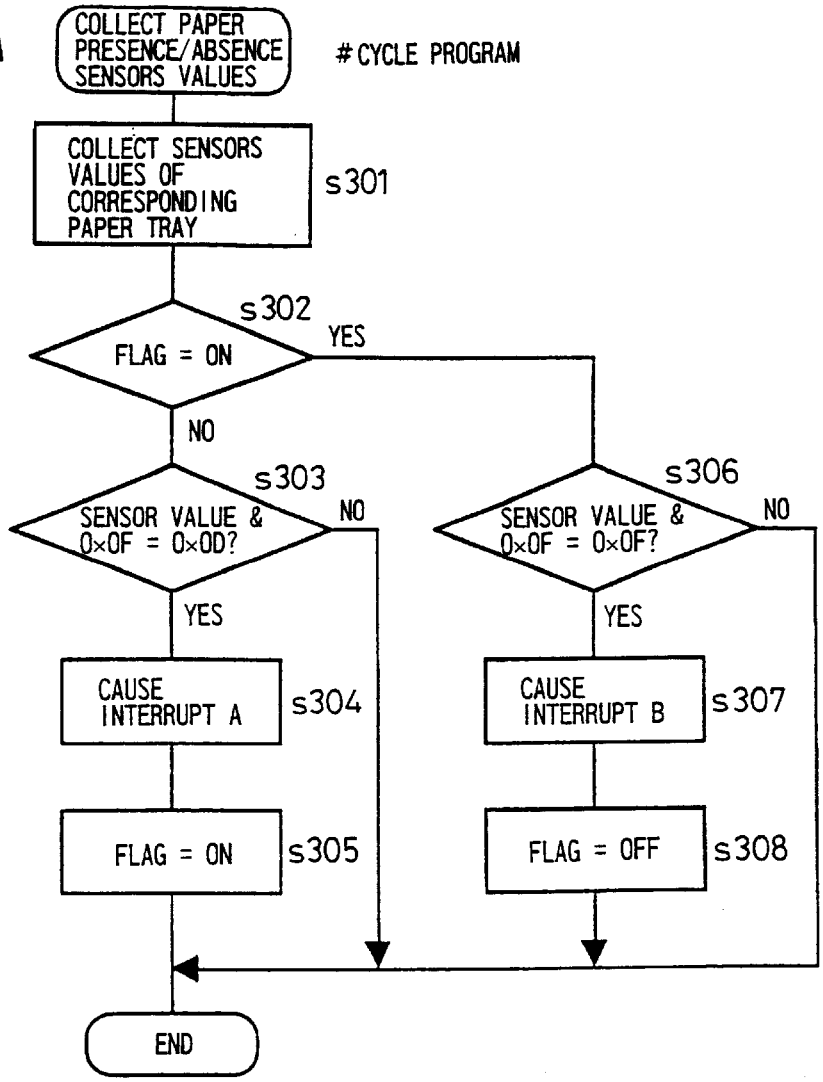
FIG. 9A is a flow chart showing a collection routine of paper presence/absence sensors which is executed periodically.
Figure 9B:
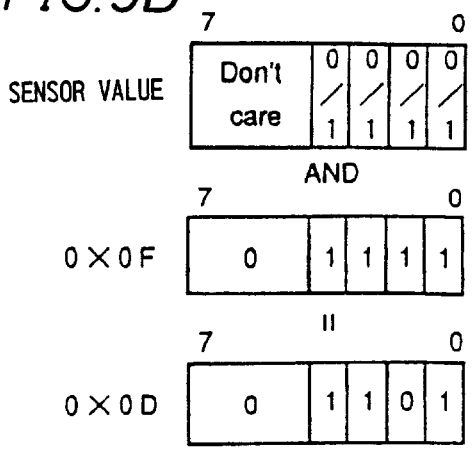
FIG. 9B is a data structure diagram in the case where the ANDing of sensor value and prescribed value 0x0F equals to 0x0D.
Figure 9C:
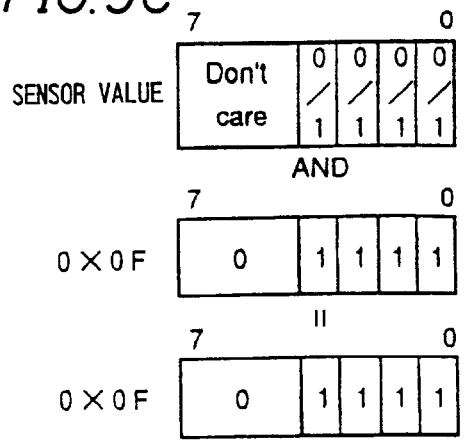
FIG. 9C is a data structure diagram in the case where the ANDing of sensor value and prescribed value 0x0F equals to 0x0F.
Figure 10:
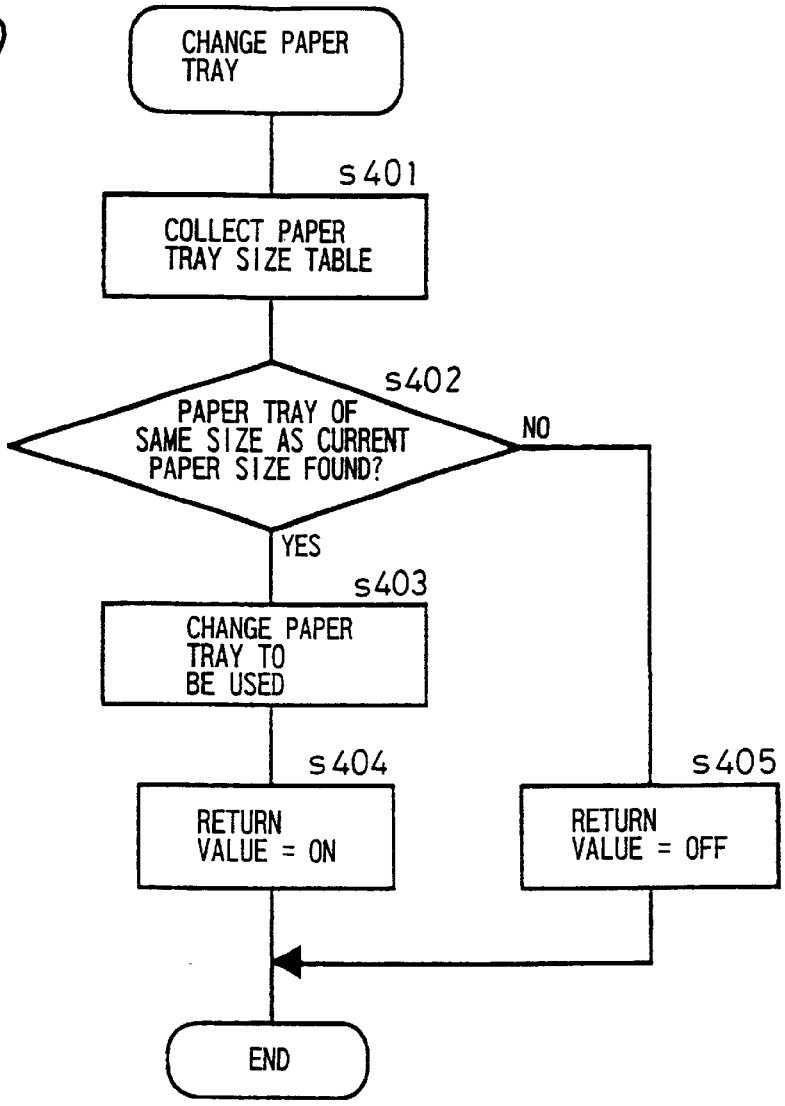
FIG. 10 is a flow chart showing a paper tray change routine.
Figure 11:
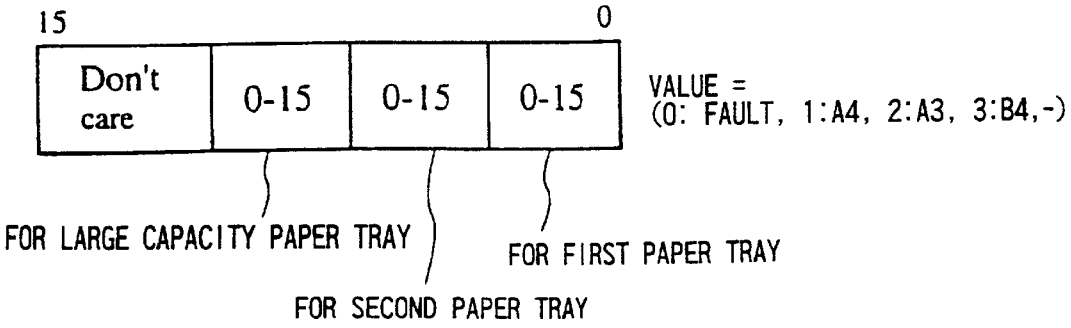
FIG. 11 is a data structure diagram for a paper tray table showing the size of paper loaded in each paper tray.
Figures 12A, 12B:
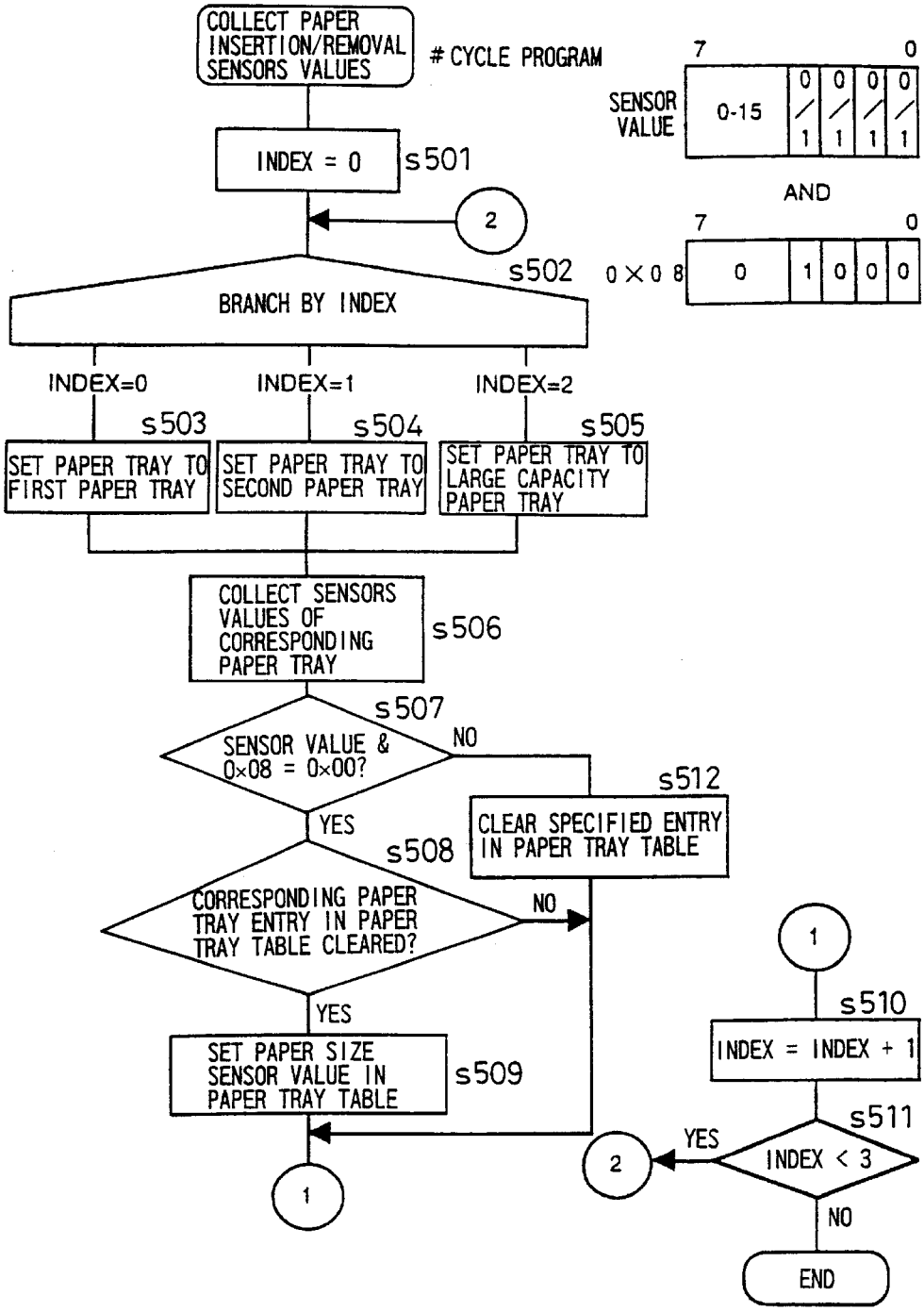
FIG. 12A is a flow chart showing a paper insertion/removal sensor collection routine which is executed periodically.
FIG. 12B is a data structure diagram showing the ANDing of sensor value and prescribed value 0x08.
Figure 13A:
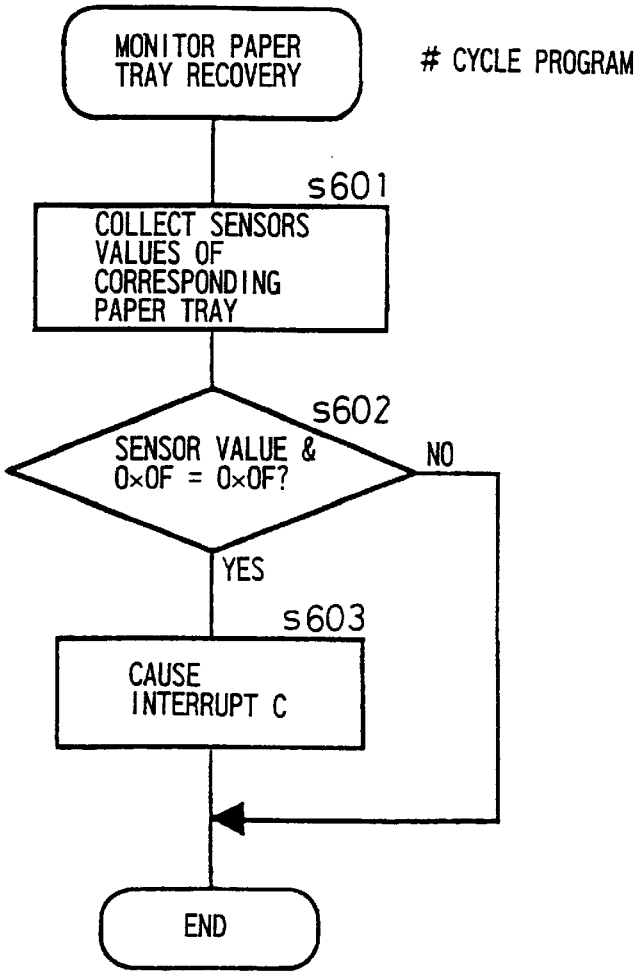
FIG. 13A is a flow chart showing a paper tray recovery monitoring routine which is executed periodically.
Figure 13B:
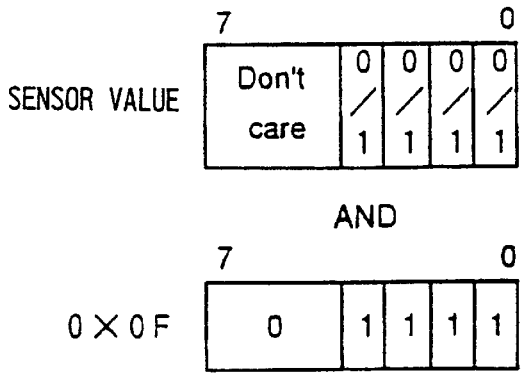
FIG. 13B is a data structure diagram showing the ANDing of sensor value and prescribed value 0x0F.

FIG. 6 is a flow chart showing a main routine for paper tray switching procedures. FIG. 7A is a flow chart showing a paper feed position sensor collection routine, and FIG. 7B is a data structure diagram showing the ANDing of sensor value and prescribed value 0x0F. FIG. 8 is a diagram showing the data format obtained when collecting the states of the various sensors. FIG. 9A is a flow chart showing a collection routine of paper presence/absence sensors which is executed periodically, FIG. 9B is a data structure diagram in the case where the ANDing of sensor value and prescribed value 0x0F equals to 0x0D, and FIG. 9C is a data structure diagram in the case where the ANDing of sensor value and prescribed value 0x0F equals to 0x0F. FIG. 10 is a flow chart showing a paper tray change routine. FIG. 11 is a data structure diagram for a paper tray table showing the size of paper loaded in each paper tray. FIG. 12A is a flow chart showing a collection routine of paper insertion/removal sensors which is executed periodically, and FIG. 12B is a data structure diagram showing the ANDing of sensor value and prescribed value 0x08. FIG. 13A is a flow chart showing a paper tray recovery monitoring routine which is executed periodically, and FIG. 13B is a data structure diagram showing the ANDing of sensor value and prescribed value 0x0F. Processing procedures performed, for example, when an out-of-paper condition occurs during printing from the paper tray 51, 52, or 53, will be described in detail below.

When a print request is entered by the user, in order to recognize the state of the paper tray 51, 52, or 53 specified by the user the paper feed position sensor collection routine of FIG. 7A for collecting the states of the various sensors is activated in step S101, and the process thus proceeds to step S201 in FIG. 7A.

In step S201, the values of the sensors on the specified paper tray are collected; in this embodiment, the states of the sensors are centrally managed in a specific component (for example, an LSI), and the output format obtained when collecting the sensor values has the data structure shown in FIG. 8, which is described in detail below.

The sensor value output format shown in FIG. 8 consists of four high/low level outputs and one sensor value which can take one of 16 possible values. In FIG. 8, the paper tray insertion/removal sensor value is obtained from the paper tray insertion/removal sensors 10 in FIG. 5, the paper presence/absence sensor value is obtained from the paper presence/absence sensor 12, the paper feed position sensor value is obtained from the paper feed position sensors 13, the paper insertion/removal position sensor value is obtained from the paper insertion/removal position sensors 14, and the paper size sensor value is obtained from the paper size sensors 11; for convenience, it is assumed here that the paper tray insertion/removal sensor value, the paper presence/absence sensor value, the paper feed position sensor value, and the paper insertion/removal position sensor value are high when the paper in the paper tray is available for printing, and that the paper size sensor value takes the value specified by the detected paper size (in this embodiment, 1 indicates A4 size, 2 indicates A3 size, and so on).

In step S202, the sensor value collected in step S201 is examined. If the AND of the sensor value and the prescribed value 0x0F is 0x0F, the process proceeds to step S203 where the return value is set to ON, and the routine is terminated. If the AND value is not 0x0F, the process proceeds to step S204 where the return value is set to OFF, and the routine is terminated. Here, the statement that the AND of the sensor value and the prescribed value 0x0F equals 0x0F means that the paper size sensor value is ignored, as shown in FIG. 7B, and indicates that all the sensor values except the paper size sensor value are all high, that is, the paper tray is ready to feed paper. In the invention, the sensor value and the prescribed value are both expressed in hexadecimal.

Turning back to FIG. 6, in step S102 the return value from the collection routine of the paper feed position sensor is examined. If the return value is ON, the process proceeds to step S103, but if the return value is not ON, the process proceeds to step S120. This means that if the paper tray is ready to feed paper, the process proceeds to step S103, but if not, the process proceeds to step S120. In this embodiment, the process performed when the paper tray specified by the user is not yet ready to feed paper, that is, the process branching to step S120 will be described first.

In steps S120 to S123 in FIG. 6, a search is made for a paper tray other than the paper tray specified by the user. First, in step S120, in order to search for a paper tray on which paper of the same size as that held in the user specified paper tray is mounted, the paper tray change routine shown in FIG. 10 is activated, and the process thus proceeds to step S401.

In step S401, the paper tray size table shown in FIG. 11 is collected. This paper tray size table carries the size of the paper contained in each of the paper trays 51, 52, and 53, i.e., the data stored in the collection routine of the paper empty sensor of FIG. 12A; the collection routine of the paper empty sensor of FIG. 12A will be described in detail later.

In step S402, the specified paper tray size is compared with each paper size stored in the paper tray size table collected in step S401. If a paper tray of the same size is found, the process proceeds to step S403 where the paper tray to be used is changed, and in the next step S404, the return value is set to ON, and the routine is terminated. If a paper tray of the same size is not found, the process proceeds to step S405 where the return value is set to OFF, and the routine is terminated.

Turning back to FIG. 6, in step S121 the return value from the paper tray change routine is examined. If it is not ON, the process proceeds to step S122. If it is ON, the process proceeds to step S124 where the paper tray recovery monitoring routine of FIG. 13 is started as a periodically activated program, after which the process returns to step 101 to resume the paper tray state check process. The periodically activated program means a routine that is executed repeatedly at periodic intervals; in the paper tray recovery monitoring routine, the originally specified paper tray before the paper tray is changed in step S120 is monitored until it becomes ready to feed paper, and this routine is activated periodically and repeatedly until the periodic execution of the program is canceled in step S141 described later.

In step S122, the print process is suspended, and a warning is issued (by displaying it on the operation panel or by sounding an alarm) to indicate that the paper tray 51, 52, or 53 is out of paper, and in step S123, it is checked to see if paper has been replenished. If paper is not replenished yet, the process returns to step S122. When paper is replenished, the process proceeds to step S101. In this way, the user is prompted to replenish paper.

Accordingly, if a paper tray of the same size as the first specified tray is found, the print process can be continued using the thus found paper tray, except the case where the other paper trays are set up to accommodate paper of different sizes.

Next, a description will be given of the collection routine of the paper insertion/removal sensor of FIG. 12A in which the size of the paper placed in each paper tray is stored in the paper tray size table shown in FIG. 11.

The collection routine of the paper insertion/removal sensor of FIG. 12A is a periodically activated program. This routine is executed periodically independently of the main routine of FIG. 6.

First, INDEX is initialized in step S501, and then the looping process from step S502 to S511 is performed. In step S502, branching by INDEX is carried out. If INDEX is 0, then in step S503 the paper tray is set to the first paper tray 51. If INDEX is 1, then in step S504 the paper tray is set to the second paper tray 52. If INDEX is 2, then in step S505 the paper tray is set to the large capacity paper tray 53. Thereafter, the same process described below is carried out.

In step S506, the sensor values of the corresponding paper tray are collected. As in step S201, it is assumed here that the output format obtained when collecting the sensor values has the data structure shown in FIG. 8. Instep S507, the sensor value collected in step S506 is examined. If the AND of the sensor value and the prescribed value 0x08 is any value other than 0x00, the process proceeds to step S508. If the AND is 0x00, the process proceeds to step S512. Here, the statement that the AND of the sensor value and the prescribed value 0x08 equals 0x00 means that the paper size sensor value, paper presence/absence value, paper feed position sensor value, and paper tray insertion/removal sensor value are ignored, as shown in FIG. 12B, and indicates that the paper insertion/removal position sensor value is low, that is, the paper tray is in the paper replenishment position.

By proceeding to step S512 when the corresponding paper tray is set in the paper replenishment position, the specified entry in the paper tray size table is cleared. On the other hand, when the paper replenishment state of the paper tray is cleared, the process proceeds to step S508. In step S508, it is determined whether the specified entry in the paper tray size table is cleared or not. If it is cleared, the process proceeds to step S509 where the paper size sensor value collected in step S506 is entered into the paper tray size table, after which the process proceeds to step S510. If it is not cleared, the process skips step S509 and proceeds to step S510. By determining in step S508 whether or not the collected sensor value should be entered in the paper tray size table, the paper tray size table is prevented from being updated when there is no change in the state of the paper tray.

In step S510, INDEX is incremented, and in step S511, it is determined whether INDEX is smaller than 3 or not. If it is smaller than 3, the process returns to step S502 to repeat the above-described looping process. If it is not smaller than 3, the process is terminated. Accordingly, whenever any one of the paper trays 51, 52, and 53 mounted in the apparatus is replenished with paper, the paper size is detected and the result is fed back to the paper tray size table.

Turning back to FIG. 6, when it is determined in step S102 that the return value from the collection routine of the paper feed position sensor is ON, that is, the paper tray is ready to feed paper, then in step S103 the collection routine of the paper presence/absence sensor of FIG. 9A is started as a periodically activated program. The periodically activated program means a routine that is executed repeatedly at periodic intervals. The collection routine of the paper presence/absence sensor has the function of detecting whether paper is available or exhausted in each paper tray, and is activated periodically and repeatedly until the periodic execution of the program is canceled in step S108 described later.

In step S104, the paper feed means 15 is activated to start feeding out paper for printing. In the next step S105, the process enters an event wait state, thus getting ready to perform processing according to the event that occurs next. The events here include a normal print termination event, an interrupt A, an interrupt B, and an interrupt C. First, the normal print termination event handling procedure from step S106 onward will be described below.

In step S107, it is determined whether the printing task requested by the user is all completed or not. If the printing task is completed, then in step S108 the collection routine of the paper presence/absence sensor of FIG. 9A is eliminated from the periodically activated program list, after which the routine is terminated. If the printing task is not yet completed, the looping process from step S104 is repeated.

Since the interrupt A event and interrupt B event are each an interrupt event from the collection routine of the paper presence/absence sensor of FIG. 9A, the process of FIG. 9A will be described below.

In step S301, as in step S201, the sensor values of the corresponding paper tray are collected. In step S302, it is determined whether FLAG is NO or not. If FLAG is ON, the process proceeds to step S306. If FLAG is not ON, the process proceeds to step S303. The initial state of FLAG is OFF, and the state is controlled to ON in later step S305 or OFF in later step S308. When the periodically activated program is first activated, the FLAG state is OFF; therefore, it is determined in step S302 that FLAG is not ON, and the process proceeds to step S303.

In step S303, it is determined whether the AND of the sensor value collected in step S301 and the prescribed value 0x0F equals 0x0D. If they are equal, the process proceeds to step S304. If they are not equal, the process is terminated.

The statement that the AND of the sensor value and the prescribed value 0x0F equals 0x0D indicates that the paper presence/absence sensor 12 has detected that paper is exhausted in the corresponding paper tray, as shown in FIG. 9B; that is, upon the detection of the out-of-paper condition, the interrupt A event is caused in step S304. Accordingly, in the event wait state in step S105, the interrupt A event is accepted when the paper tray is out of paper. After causing the interrupt A event in step S304, FLAG is set ON, after which the process is terminated. As a result, in step S302 in the next cycle of execution, the branch to step S306 is followed.

In step S306, it is determined whether the AND of the sensor value and the prescribed value 0x0F equals 0x0F. If they are equal, the process proceeds to step S307. If they are not equal, the process is terminated. The statement that the AND of the sensor value and the prescribed value 0x0F equals 0x0F indicates that the corresponding paper tray is in the paper feed ready state, as shown in FIG. 9C. The processing in step S306 is carried out when the paper tray has made a transition to the paper feed ready state after running out of paper, as indicated by the FLAG ON state.

Accordingly, when the AND of the sensor value and the prescribed value0x0F equals 0x0F, it means that the corresponding paper tray has made a transition to the paper feed ready state; therefore, after causing the interrupt B event in step S307, FLAG is set OFF in step S308, and the process is terminated.

In the event wait state in step S105, the interrupt B event is accepted when, after running out of paper, the paper tray is replenished with paper and set in the paper feed position, thus getting ready to feed paper.

In the interrupt event A handling procedure from step S110 onward, which is initiated when the paper tray runs out of paper, first the paper tray change routine of FIG. 10 (already described) is executed in step S111, then it is determined in step S112 whether the return value is ON or not. If it is not ON, then in steps S113 and S114 the user is prompted to replenish paper, as in steps S122 and S123. If the return value is ON, an indication is produced in step S115 indicating that the paper tray used will be switched to another paper tray, while prompting the user to replenish the currently used and now empty paper tray with paper; after that, the process returns to step S101 to resume the printing process using that other paper tray.

When the user replenishes the paper tray with paper, the paper feed ready state of the paper tray is recognized in the collection routine of the paper presence/absence sensor of FIG. 9A, and the process thereafter proceeds to step S130 to accept the interrupt B event. In step S131, switching is made from the paper tray being used as a substitute because of the out-of-paper condition to the paper tray that has been put out of use but now replenished with paper, thus accomplishing switching to the paper tray originally specified by the user. In this way, by using a substitute paper tray when the original paper tray runs out of paper, the time required to complete the printing can be reduced. That is, the apparatus can be prevented from being placed in a standby state due to paper out, and the paper accommodating section requested by the user can be preferentially selected for printing.

Next, the interrupt C event is an interrupt event from the paper tray recovery monitoring routine of FIG. 13A initiated in step S124; therefore, the process of FIG. 13A will be described below.

In step S601, as in step S201, the sensor values of the corresponding paper tray are collected. In step S602, it is determined whether the AND of the sensor value collected in step S601 and the prescribed value 0x0F equals 0x0F. If they are equal, the process proceeds to step S603 to cause the interrupt C event, and after that, the process is terminated. If they are not equal, the process is immediately terminated. The paper tray recovery monitoring routine is started as a periodically activated program.

The statement that the AND of the sensor value and the prescribed value 0x0F equals 0x0F indicates that the corresponding paper tray is in the paper feed ready state, as shown in FIG. 13B. Further, since the paper tray recovery monitoring routine of FIG. 13A is initiated when it is determined in step S102 that the paper tray is not in the paper feed ready state, the determination in step S602 that the AND of the sensor value and the prescribed value 0x0F equals 0x0F means that the paper tray originally specified by the user has made a transition to the paper feed ready state.

Accordingly, in the event wait state in step S105, the interrupt C event is accepted in such cases where when printing is started while the specified paper tray is not yet ready to feed paper, the printing is performed using a substitute paper tray and thereafter the paper tray originally specified by the user becomes ready to feed paper.

In the procedure starting from step S140 that accepts the interrupt C event, in step S141 the paper tray recovery monitoring routine of FIG. 13A is eliminated from the periodically activated program list. Then, in step S142, switching is made from the substitute paper tray to the paper tray that was placed in the standby state, thus accomplishing switching to the paper tray originally specified by the user.

As described, when the specified paper tray is not yet ready to feed paper at the time of the occurrence of a print request, a paper tray that is ready to feed paper immediately is used as a substitute; in this way, the first copy time of the apparatus can be shortened.

As an example illustrating the above situation, when making a large number of copies, the user replenishes the large capacity paper tray 53 with paper before starting the printing operation, and starts the printing operation after selecting the large capacity paper tray 53 as the paper tray to be used for printing. However, when the printing is started, if the large capacity paper tray 53 has not yet reached the paper feed position, the process does not wait until the large capacity paper tray 53 reaches the paper feed position; rather, if there is any other paper tray that holds the same size paper as the large capacity paper tray 53, for example, if the first paper tray 51 contains the same size paper, then the state of that paper tray is checked and, if it is ready to feed paper, the first paper tray 51 is used until the large capacity paper tray 53 becomes ready. This can prevent the print process from being delayed due to the apparatus standby state that can occur after replenishing paper. That is, by preferentially operating the paper accommodating section that is already in the paper feed ready state, the first copy time can be reduced. Furthermore, the cumulative number of sheets handled by the paper feed means 15 can be substantially equalized between the two paper accommodating sections 53*a* and 53*b* so that both paper feed means 15 can be replaced at a time.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

an image forming section for forming an image on paper;

a first paper accommodating section for accommodating therein prescribed size paper specified to be fed to the image forming section, the first paper accommodating section being movable between a paper replenishment position where paper can be replenished, and a paper feed position where the paper is ready to be fed out;

a second paper accommodating section for accommodating therein paper of the same size as the paper held in the first paper accommodating section, the second paper accommodating section being movable between a paper replenishment position where paper can be replenished, and a paper feed position where the paper is ready to be fed out, and requiring a longer time than that of the first paper accommodating section to transport the paper to the image forming section;

paper feed means, provided for each of the paper accommodating sections, for feeding the paper placed in the paper accommodating sections to the image forming section one sheet of paper at a time; and a paper feed control section for performing control in such a manner that when setting each of the first and second paper accommodating sections from the paper replenishment position to the paper feed position, in the case where one of the paper accommodating sections has been set into the paper feed position earlier than the other paper accommodating section, paper feed is started from the paper accommodating section that has been set into the paper feed position earlier, wherein, independent of a position of one of the first and second paper accommodating sections, paper feed from the other of the first and second accommodating sections to the image forming apparatus is possible.

2. The image forming apparatus of claim 1, wherein the paper feed control section performs control in such a manner that when setting each of the first and second paper accommodating sections from the paper replenishment position to the paper feed position, in the case where the first paper accommodating section has been set into the paper feed position earlier than the second paper accommodating section, paper feed is first started from the first paper accommodating section, and after the second paper accommodating section has been set into the paper feed position and become ready to feed paper following the paper being fed out of the first paper accommodating section, paper feed from the first paper accommodating section is stopped and paper feed from the second paper accommodating section is started.

3. The image forming apparatus of claim 1, wherein the paper feed control section performs control in such a manner that when setting each of the first and second paper accommodating sections from the paper replenishment position to the paper feed position, in the case where the second paper accommodating section has been set into the paper feed position earlier than the first paper accommodating section, paper feed is first started from the second paper accommodating section, and after the first paper accommodating section has been set into the paper feed position and become ready to feed paper following the paper being fed out of the second paper accommodating section, paper feed from the second paper accommodating section is stopped and paper feed from the first paper accommodating section is started.

4. An image forming apparatus comprising:

an image forming section for forming an image on paper;

a first paper accommodating section for accommodating therein prescribed size paper specified to be fed to the image forming section, the first paper accommodating section being movable between a paper replenishment position where paper can be replenished, and a paper feed position where the paper is ready to be fed out;

a second paper accommodating section for accommodating therein paper of the same size as the paper held in the first paper accommodating section, the second paper accommodating section being movable between a paper replenishment position where paper can be replenished, and a paper feed position where the paper is ready to be fed out, and requiring a longer time than that of the first paper accommodating section to transport the paper to the image forming section;

paper feed means, provided for each of the paper accommodating sections, for feeding the paper placed in the paper accommodating section to the image forming section one sheet of paper at a time; and a paper feed control section for performing control in such a manner that when feeding paper from the second paper accommodating section to the image forming section, in the case where the second paper accommodating section runs out of paper, an indication is produced signaling the need to replenish the second paper accommodating section with paper, while at the same time, paper is fed out of the first paper accommodating section, following the paper fed out of the second paper accommodating section, thereafter, when the second paper accommodating section has been replenished with paper, and when the second paper accommodating section has been set into the paper feed position and become ready to feed paper following the paper being fed out of the first paper accommodating section, paper feed from the first paper accommodating section is stopped and paper feed from the second paper accommodating section is resumed, and wherein, independent of a position of one of the first and second paper accommodating sections, paper feed from the other of the first and second accommodating sections to the image forming apparatus is possible.

* * * * *